US008499965B2

(12) United States Patent
Sheffield

(10) Patent No.: US 8,499,965 B2
(45) Date of Patent: Aug. 6, 2013

(54) DISPENSER FOR AN ORALLY DISSOLVABLE STRIP

(76) Inventor: Wanda Sheffield, Stockton, CA (US)

( * ) Notice: Subject to any disclaimer, the term of this patent is extended or adjusted under 35 U.S.C. 154(b) by 33 days.

(21) Appl. No.: 13/184,713

(22) Filed: Jul. 18, 2011

(65) Prior Publication Data

US 2011/0271811 A1 Nov. 10, 2011

Related U.S. Application Data

(63) Continuation-in-part of application No. 12/187,979, filed on Aug. 7, 2008, now abandoned.

(51) Int. Cl.
*B65H 1/00* (2006.01)
*B65H 16/10* (2006.01)
*A61J 1/00* (2006.01)

(52) U.S. Cl.
USPC ..... 221/45; 221/42; 221/93; 221/127

(58) Field of Classification Search
USPC ..... 221/93, 127, 42, 45, 72
See application file for complete search history.

(56) References Cited

U.S. PATENT DOCUMENTS

| | | | | |
|---|---|---|---|---|
| 5,529,490 | A * | 6/1996 | Klein et al. | 433/3 |
| 5,782,377 | A * | 7/1998 | Fassman | 221/94 |
| 5,957,358 | A * | 9/1999 | Getz et al. | 225/77 |
| 6,848,593 | B2 * | 2/2005 | Papp | 221/25 |
| 6,962,266 | B2 * | 11/2005 | Morgan et al. | 221/25 |
| 7,987,845 | B2 * | 8/2011 | King et al. | 128/203.15 |
| 2007/0289987 | A1 * | 12/2007 | Tramontina et al. | 221/96 |
| 2010/0018987 | A1 * | 1/2010 | Hamer | 221/25 |

* cited by examiner

*Primary Examiner* — Michael K Collins
(74) *Attorney, Agent, or Firm* — Dale J. Ream

(57) ABSTRACT

A dispenser for an orally dissolvable strip includes a pair of receiving spools for receiving respective layers of wrap material that sandwich the orally dissolvable strip. A rotatable knob is coupled to the spools for actuating the spools. A force transfer apparatus is configured to rotate the second spool when the first spool rotates. A housing contains the receiving spools, force transfer apparatus, orally dissolvable strip, and layers of wrap material, the housing having a slot sized for the dissolvable strip to pass through. A coupling element is connected to a housing side wall configured connect the housing laterally to another housing side wall. A channel extends between a knob input aperture and a housing rear plate output channel. A drive shaft is positioned in the channel and configured to extend from the output channel and operatively couple the rotatable knob with a rotatable knob of another dispenser.

17 Claims, 23 Drawing Sheets

DISPENSER FOR AN ORALLY DISSOLVABLE STRIP

CROSS REFERENCE TO RELATED APPLICATIONS

This application is a continuation-in-part of patent application Ser. No. 12/187,979 filed on Aug. 7, 2008 now abandoned entitled Dispenser for an Orally Dissolvable Strip.

BACKGROUND OF THE INVENTION

This invention relates generally to pharmaceutical dispensers and, more particularly, to a dispenser that stores and dispenses orally dissolvable strips.

For many years, most prescription and over-the-counter medications have been dispensed in pill or liquid form. Pill medication, of course, is typically dispensed in bottles although it may also be dispensed in foil packages. More recently, however, pharmaceuticals have been provided in the form of orally dissolvable strips. Each thin strip dissolves very quickly on a consumer's tongue and is then absorbed into the body.

Orally dissolvable strips have typically been dispensed as a stack of strips packaged in a box, each medicinal strip being sandwiched between thin strips of plastic so as to maintain purity and to keep the strips from sticking to one another. Although assumably effective for their intended use, the traditional packaging of orally dissolvable medicine strips requires a user first separate one strip from others in a stack, peel the plastic separator strips away from a respective medicine strip, and then to dispose of the separate films. Another disadvantage of dispensing pharmaceuticals, whether pills or orally dissolvable strips, is that a patient may require a multitude of different medicaments multiple times a day. Each time, many bottles or many strips must be opened or dispensed, requiring valuable time and introducing the potential for errors to be made.

Therefore, it would be desirable to have a dispenser for delivering orally dissolvable strips. Further, it would be desirable to have a dispenser that automatically separates a medicine strip from the plastic separator strips as the medicine strip is dispensed. In addition, it would be desirable to have a dispenser that collects the separator strips after they have been separated from the medicine strip and the medicine strip has been dispensed. Still further, it would be desirable to have a dispenser the enables multiple dispensers to be operatively connected in a manner enabling strips from multiple dispensers to be dispensed simultaneously and with the operation of only a single input element.

SUMMARY OF THE INVENTION

A dispenser for an orally dissolvable strip includes a pair of receiving spools for receiving respective layers of wrap material that sandwich the orally dissolvable strip. A rotatable knob is coupled to the spools for actuating the spools. A force transfer apparatus is configured to rotate the second spool when the first spool rotates. A housing contains the receiving spools, force transfer apparatus, orally dissolvable strip, and layers of wrap material, the housing having a slot sized for the dissolvable strip to pass through. A coupling element is connected to a housing side wall configured connect the housing laterally to another housing side wall. A channel extends between a knob input aperture and a housing rear plate output channel. A drive shaft is positioned in the channel and configured to extend from the output channel and operatively couple the rotatable knob with a rotatable knob of another dispenser.

Therefore, a general object of this invention is to provide a dispenser for selectively dispensing an orally dissolvable medicine strip.

Another object of this invention is to provide a dispenser, as aforesaid, that separates the medicine strip from the wrapping strips between which the medicine strip is sandwiched.

Still another object of this invention is to provide a dispenser, as aforesaid, that collects the wrapping strips for later disposal.

Yet another object of this invention is to provide a dispenser, as aforesaid, in which all components are held within a protective housing.

A further object of this invention is to provide a dispenser, as aforesaid, that is cost-effective and user-friendly.

A particular object of this invention is to provide a dispenser, as aforesaid, that may be coupled laterally to another dispenser in a side-by-side configuration;

Another particular object of this invention is to provide a dispenser, as aforesaid, having structures such that two or more dispensers may be coupled in a front to back configuration and actuated to dispense respective orally disposable strips upon actuation only of the first dispenser.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

A dispensing apparatus will now be described in detail with reference to FIG. 1 through FIG. 7*b* of the accompanying drawings. More particularly, a dispenser 100 for an orally dissolvable strip 10 sandwiched between first and second layers of wrap material 15*a*, 15*b* includes first and second receiving spools 110*a*, 110*b* for receiving the respective layers of wrap material 15*a*, 15*b*. The orally dissolvable strip 10 may include a medication, a breath freshener, or a nutritional supplement, for example, and a release material (e.g., a food-grade powder) may be between the orally dissolvable strip and the layers of wrap material 15*a*, 15*b*. The wrap material 15*a*, 15*b* may be constructed from plastic, wax paper, parchment paper, or other appropriate materials.

Figure 3:
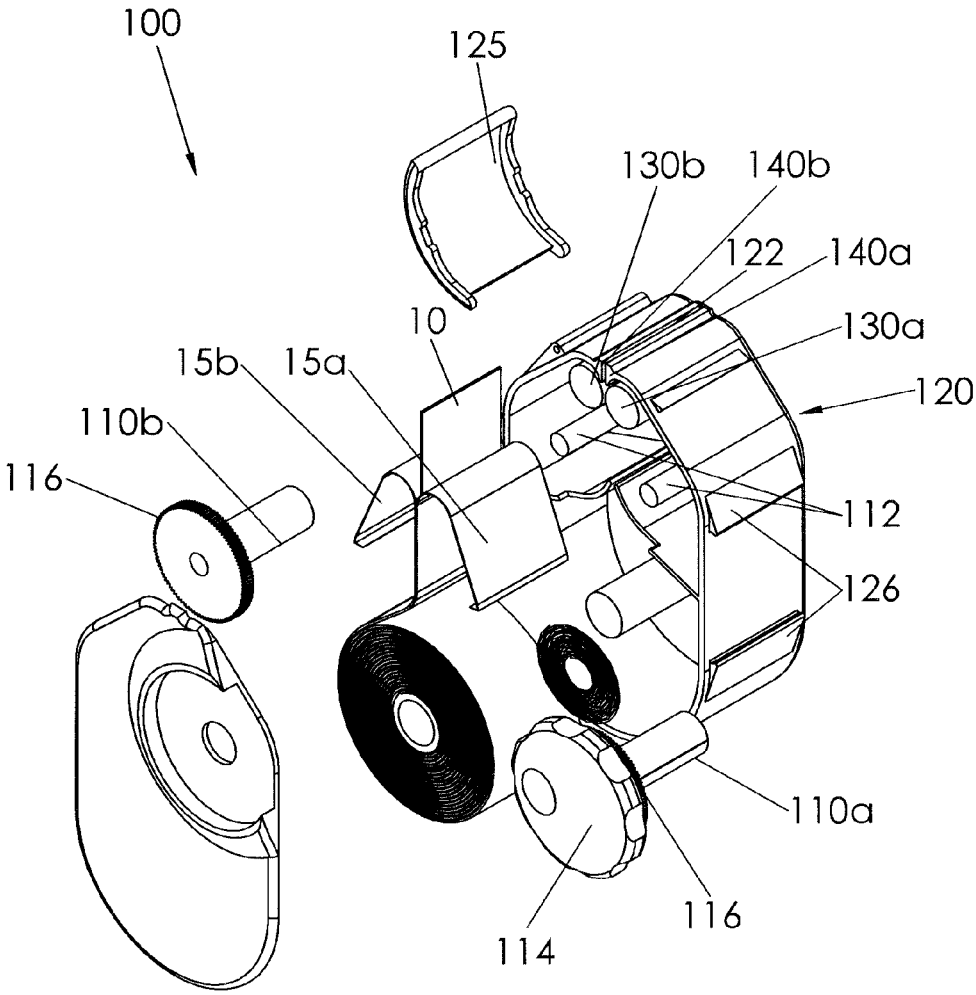
FIG. 3 is an exploded view of the dispenser as in FIG. 2.
Figure 5:
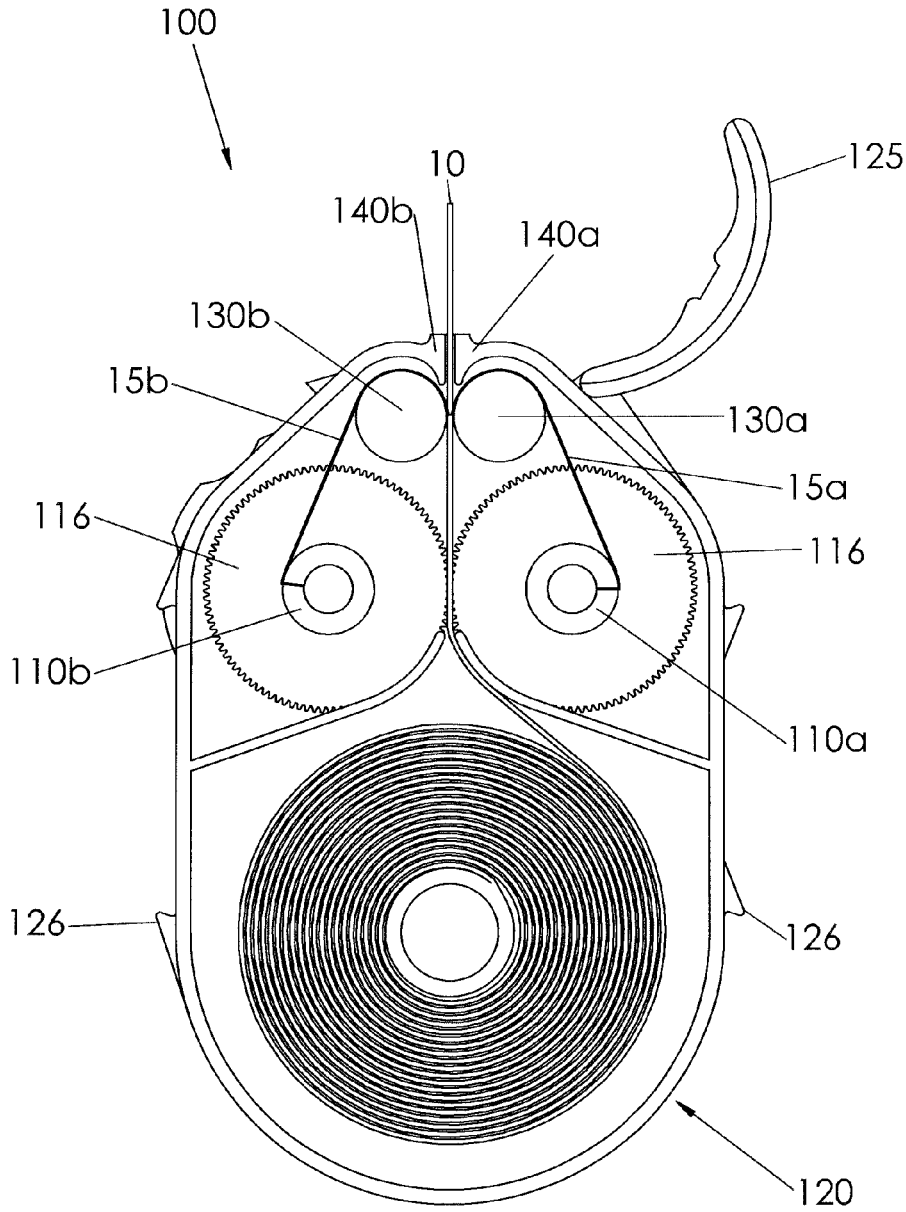
FIG. 5 is a rear view of the dispenser as in FIG. 2 with a rear wall removed for clarity.

As shown in FIG. 3 and FIG. 5, the spools 110*a*, 110*b* are generally parallel to one another and spaced apart for the orally dissolvable strip 10 and the layers of wrap material 15*a*, 15*b* to pass between. The first spool 110*a* may be operatively coupled to the first layer of wrap material 15*a* (i.e., the layer of wrap material between the first spool 110*a* and the orally dissolvable strip 10), and the second spool 110*b* may be operatively coupled to the second layer of wrap material 15*b* (i.e., the layer of wrap material between the second spool 110*b* and the orally dissolvable strip 10). Posts 112 may receive the spools 110*a*, 110*b* so that the spools 110*a*, 110*b* are rotatable about the posts 112, and means for rotating the first spool 110*a* may be included. For example, a rotatable knob 114 may be operatively coupled to the first spool 110*a*. Devices that convert linear motion to rotational motion and devices that use electronic motors may similarly be used.

Figure 4:
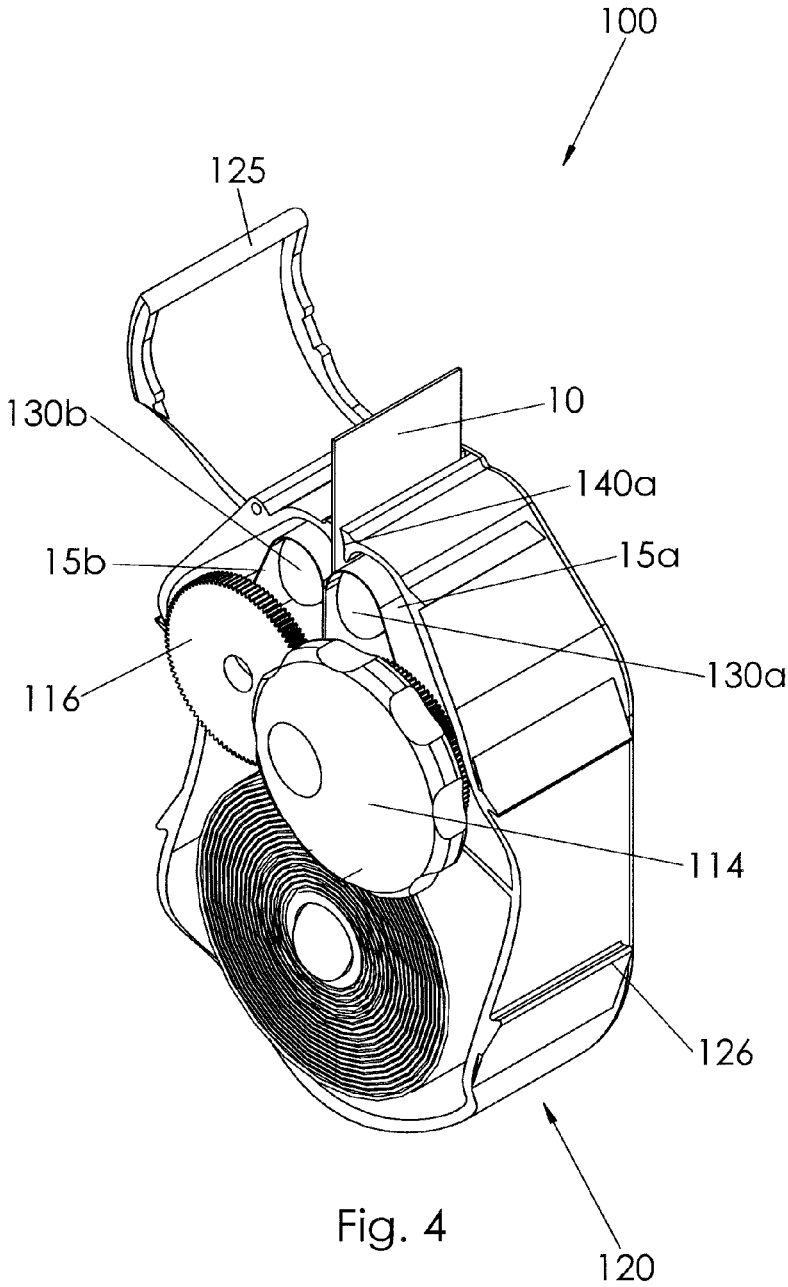
FIG. 4 is another perspective view of the dispenser as in FIG. 2 with a front wall removed for clarity.

As shown in FIG. 3 through FIG. 5, a force transfer apparatus 116 (e.g., a gear train, pulley system, chain and sprocket system, etc.) is configured to rotate the second spool 110*b* when the first spool 110*a* rotates. The first and second spools 110*a*, 110*b* and the force transfer apparatus are collectively configured so that the first and second spools 110*a*, 110*b* each receive a generally equivalent length of the wrap material 15*a*, 15*b* when the first and second spools 110*a*, 110*b* rotate. For example, the first and second spools 110*a*, 110*b* may be of generally equivalent size, and the force transfer apparatus 116 may be configured to rotate the second spool 110*b* at generally the same speed as the first spool 110*a*. In at least one embodiment (as shown in FIG. 5), the first and second spools 110*a*, 110*b* rotate only in opposed directions.

Figure 6:
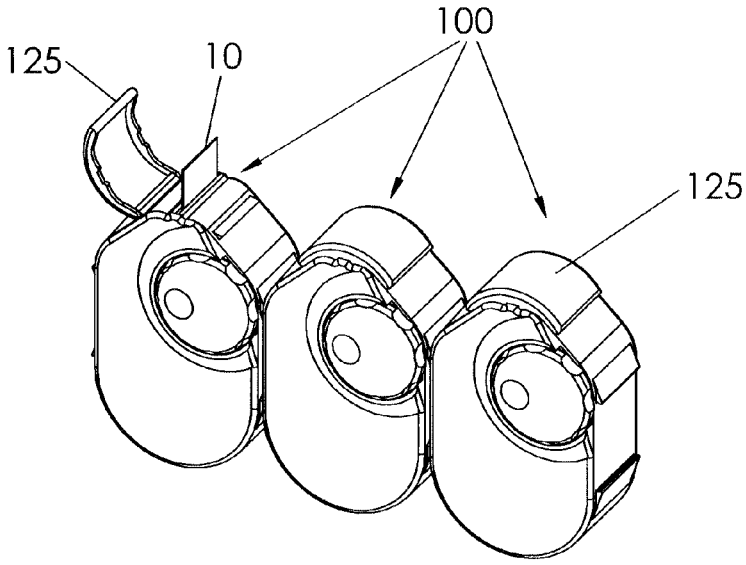
FIG. 6 is a perspective view of multiple dispensers being coupled together.
Figure 7A:
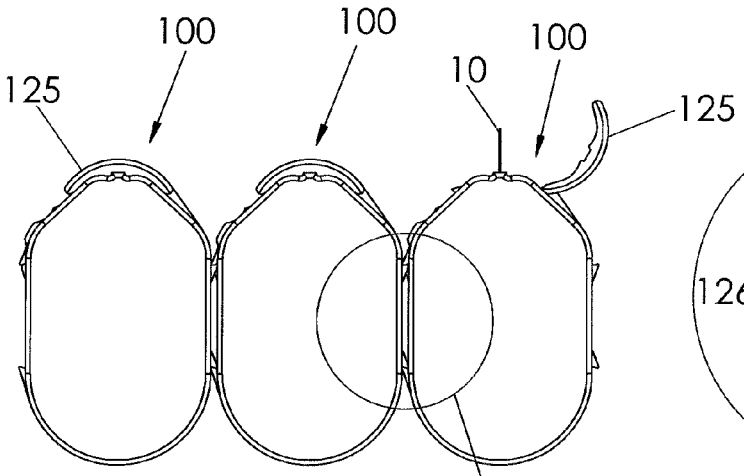
FIG. 7A is a rear view of the multiple dispensers as in FIG. 6.
Figure 7B:
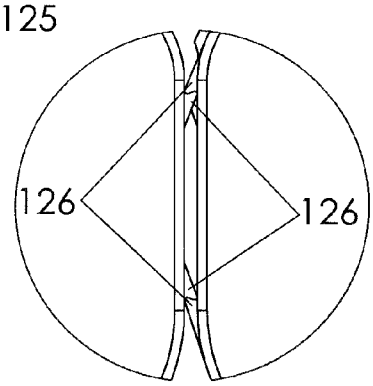
FIG. 7B is an isolated view on an enlarged scale of a coupling element of the dispensers taken from FIG. 7A.
Figure 8:
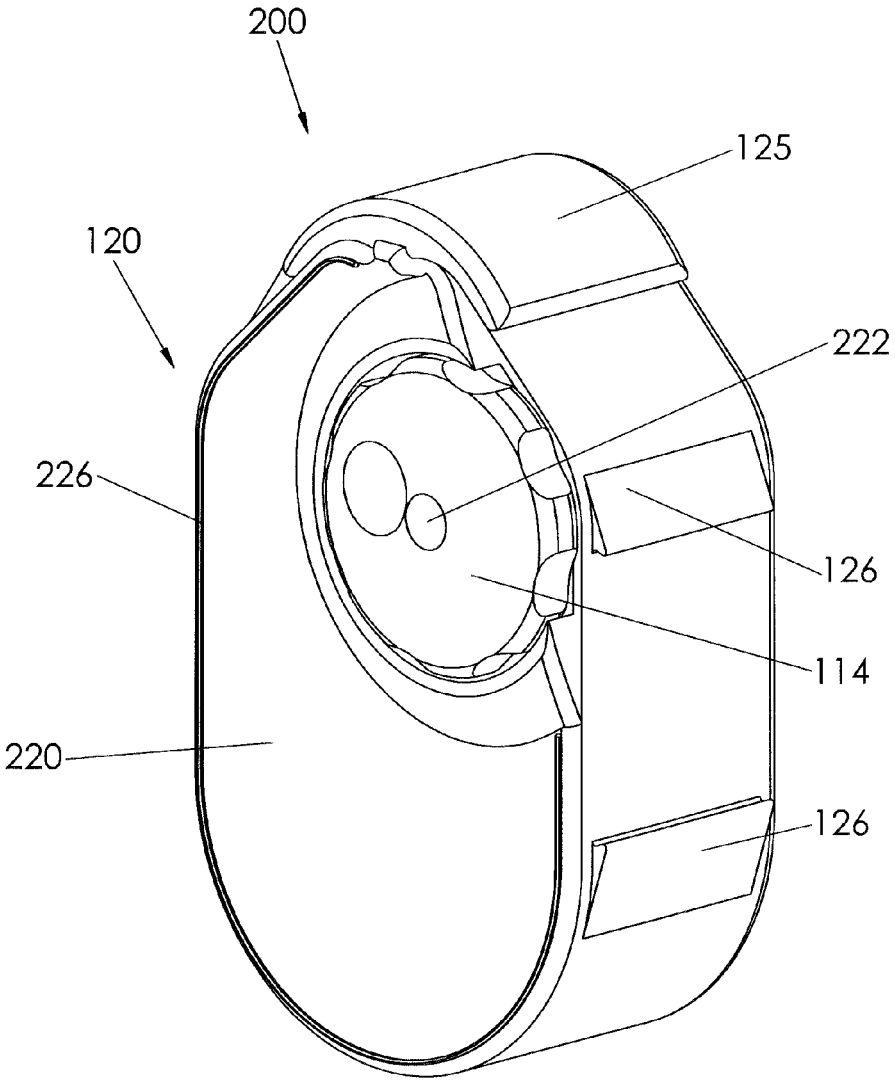
FIG. 8 is a perspective view of the dispenser according to another embodiment of the present invention with the cap in a closed configuration.
Figure 9:
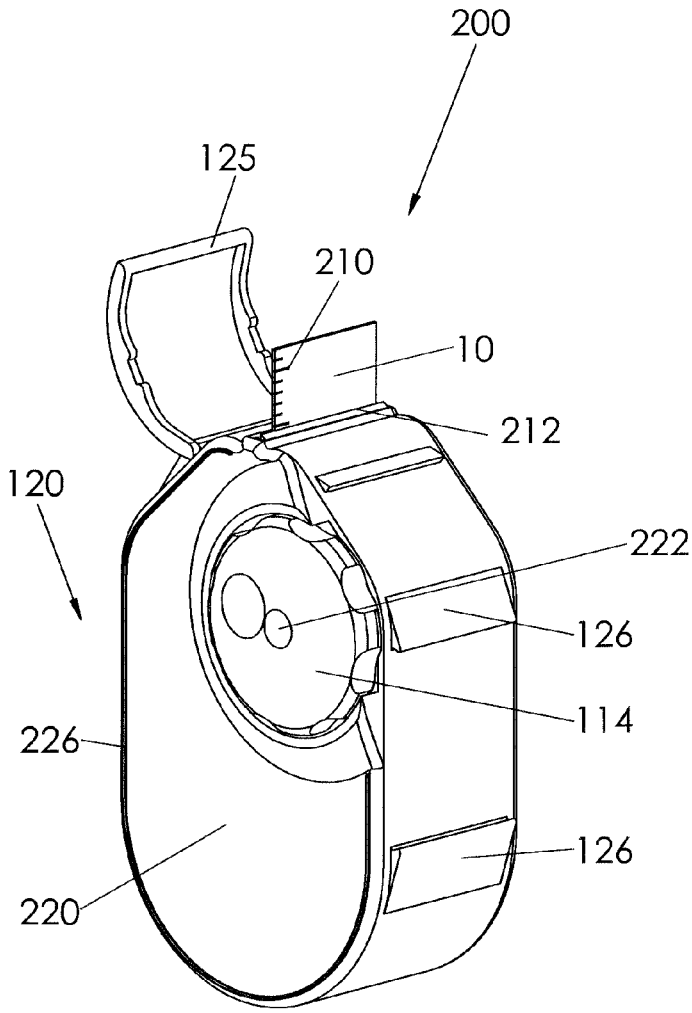
FIG. 9 is another perspective view of the dispenser as in FIG. 8 with the cap in an open configuration.

The dispenser 10 includes a housing 120 having opposed front 121*a* and rear 121*b* plates with opposed side walls 123 connecting the front 121*a* and rear 121*b* plates. As shown in the drawings, the side walls may include a rounded configuration; however, it is understood that the side walls may be substantially planar and in such case the housing 120 may also include opposed top and bottom walls. Together, the plates and walls of the housing 120 define an interior area configured to contain the receiving spools 110*a*, 110*b*, the orally dissolvable strip 10, the layers of wrap material 15*a*, 15*b*, and the force transfer apparatus 116. The housing 120 has a slot 122 sized for the orally dissolvable strip 10 to pass through (FIG. 2), and the means for rotating the first spool 110*a* is accessible outside the housing 120. A protective cap 125 may be movably coupled to the housing 120 to selectively expose (FIG. 2) and conceal (FIG. 1) the housing slot 122. In some embodiments, the housing 120 is airtight when the cap 125 conceals the housing slot 122. As shown in FIGS. 6 through 7*b*, a coupling element 126 may be connected to a side wall 123 of the housing 120 that is configured to selectively couple the housing 120 laterally to a housing 120 of another dispenser 100. In other words, multiple housings 120 may be coupled together side by side so as to conveniently make different types of dissolvable strips available to a user.

First and second guide rollers 130*a*, 130*b* (FIG. 4 and FIG. 5) may be in the housing 120 adjacent the housing slot 122 to direct the orally dissolvable strip 10 out the housing slot 122. The first layer of wrap material 15*a* may pass over the first guide roller 130*a* before reaching the first receiving spool 110*a*, and the second layer of wrap material 15*b* may pass over the second guide roller 130*b* before reaching the second receiving spool 110*b*. The first and second guide rollers 130*a*, 130*b* may be positioned (e.g., adjacent to one another) to cause generally adjacent points of the two layers of wrap material 15*a*, 15*b* to separate from the orally dissolvable strip at generally the same time. A first wedge 140*a* may be positioned between the first guide roller 130*a* and the orally dissolvable strip 10 to aid in separating the first layer of wrap material 15*a* from the orally dissolvable strip 10, and a second wedge 140*b* may be positioned between the second guide roller 130*b* and the orally dissolvable strip 10 to aid in separating the second layer of wrap material 15*b* from the orally dissolvable strip 10, as shown in FIG. 5. The first and second wedges 140*a*, 140*b* may be in the housing 120.

Figure 1:
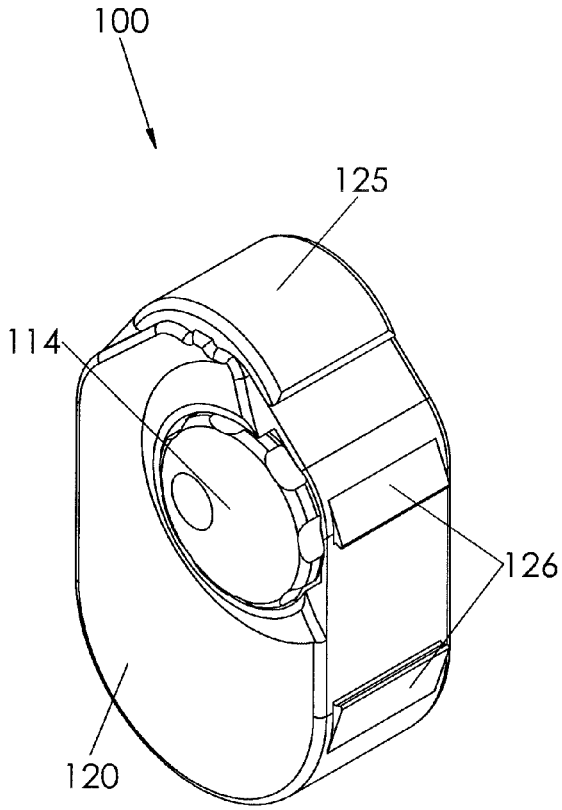
FIG. 1 is a perspective view of a dispenser of an orally dissolvable strip with a cap in an open configuration.
Figure 2:
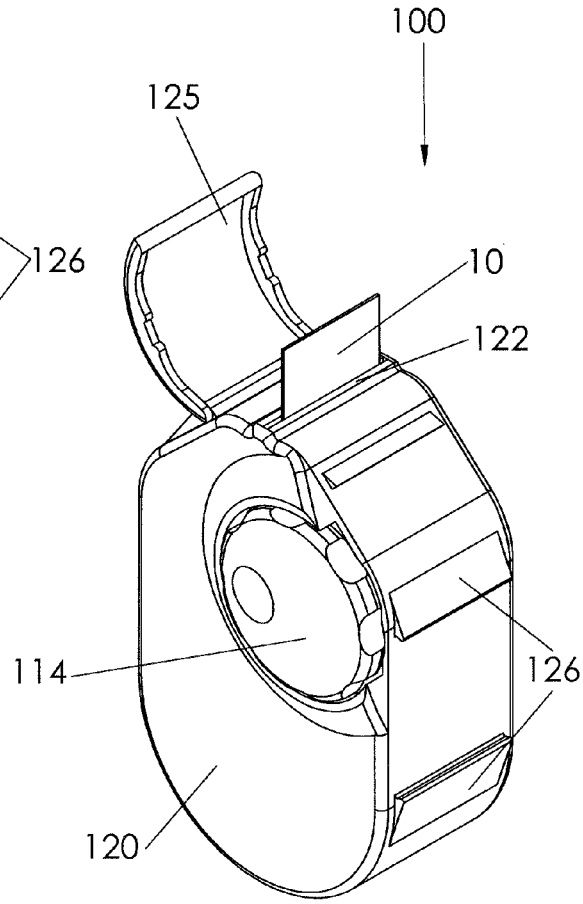
FIG. 2 is a perspective view of the dispenser as in FIG. 1 with a cap in a closed configuration.

In use, the user opens the cap 125 (FIG. 2) and causes the first spool 110*a* to rotate, such as by using the rotatable knob 114. The force transfer apparatus 116 causes the second spool 110*b* to rotate when the first spool 110*a* rotates. As the spools 110*a*, 110*b* rotate, the first layer of wrap material 15*a* is separated from the orally dissolvable strip 10, pulled around the first guide roller 130*a*, and wrapped around the first spool 110*a*. Similarly, the second layer of wrap material 15*b* is separated from the orally dissolvable strip 10, pulled around the second guide roller 130*b*, and wrapped around the second spool 110*b*. The guide rollers 130*a*, 130*b* position the orally dissolvable strip 10 and the layers of wrap material 15*a*, 15*b* and cause the orally dissolvable strip 10 to proceed out the slot 122 as the layers of wrap material 15*a*, 15*b* are wound around the spools 110*a*, 110*b*. The wedges 140*a*, 140 may help in guiding the orally dissolvable strip 10 out the slot 122 and/or may help separate the wrap material 15*a*, 15*b* from the orally dissolvable strip 10. By collectively configuring the first and second spools 110*a*, 110*b* and the force transfer apparatus so that the first and second spools 110*a*, 110*b* each receive a generally equivalent length of the wrap material 15*a*, 15*b* when the first and second spools 110*a*, 110*b* rotate, the orally dissolvable strip 10 may be moved effectively through the housing 120 and out the slot 122, and the wrap material 15*a*, 15*b* may be orderly wrapped around the spools 110*a*, 110*b*. After the orally dissolvable strip 10 passes through the slot 122 and is separated from the dispenser 100, the cap 125 may be closed (FIG. 1).

As shown in FIGS. 6 through 7*b*, multiple dispensers 100 may be laterally coupled to one another (e.g., by the coupling elements 126) if desired. This may be desirable, for example, to keep different orally dissolvable strips 10 (e.g., different medications, different nutritional supplements, different flavors of breath freshener, etc.) together.

The dispenser may be discarded after the orally dissolvable strip 10 is entirely removed from the housing 120, or the housing 120 may be reusable. For example, a cassette holding the orally dissolvable strip 10, the layers of wrap material 15*a*, 15*b*, the first and second receiving spools 110*a*, 110*b*, and the first and second guide rollers 130*a*, 130*b* may be replaceable by opening the housing 120.

Another embodiment of a dispenser 200 is shown in FIGS. 8 to 25 and includes a construction substantially as previously described except as specifically noted below. Elements that are the same as those described previously are designated by the same reference numerals used previously. In this embodiment, a channel 224 extends through the housing 120 between an input aperture 222 defined by the rotatable knob 114 and an output aperture 232 defined by the rear plate 230. It is understood that the channel 224 may be defined by the tubular element of the second spool 110*b*. The channel 224 may include a hexagonal configuration so that rotation of the knob 114 does not occur inadvertently as will be described later, although other configurations would also be suitable. The rear plate 230 may also include a boss 231 extending outwardly through which the transfer drive shaft 250 will extend as will be understood later. When not in use, the input aperture 222 may be made inaccessible by insertion of a front access plug 226 plug 227. Similarly, a rear access plug 234 may be inserted into the rear plate output aperture 232 to prevent access thereto when not in use.

Figure 11A:
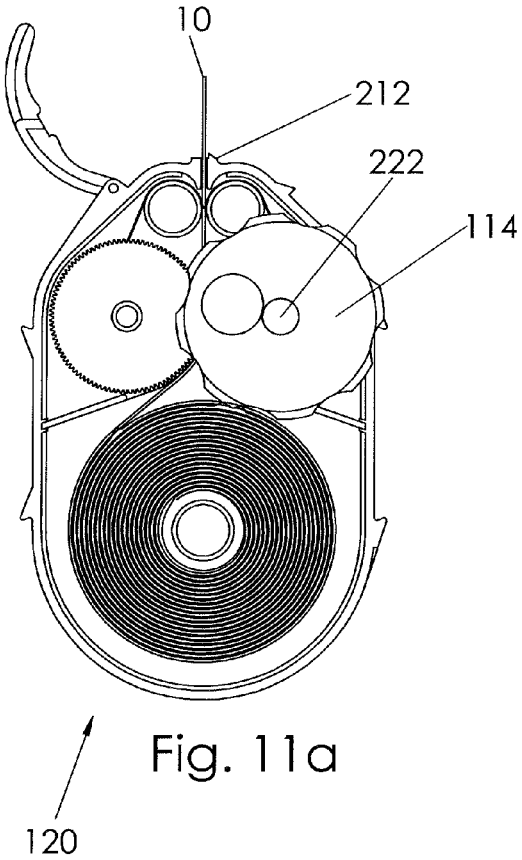
FIG. 11*a* is a front view of the dispenser as in FIG. 10*a;*
Figure 11B:
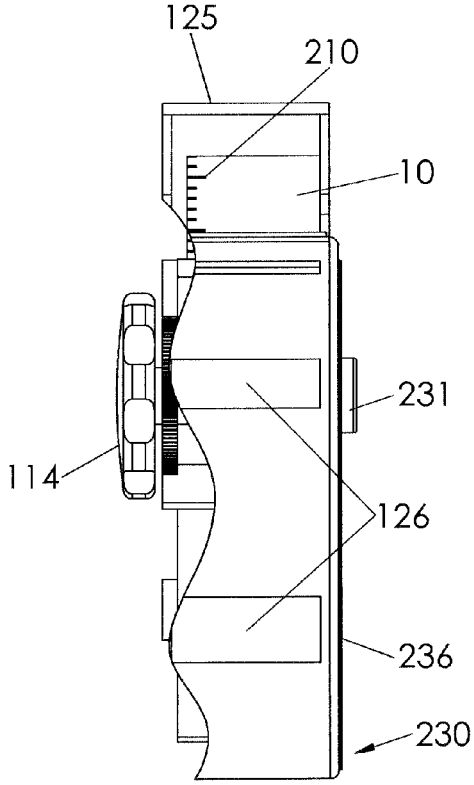
FIG. 11*b* is a side view of the dispenser as in FIG. 10*a;*
Figure 12:
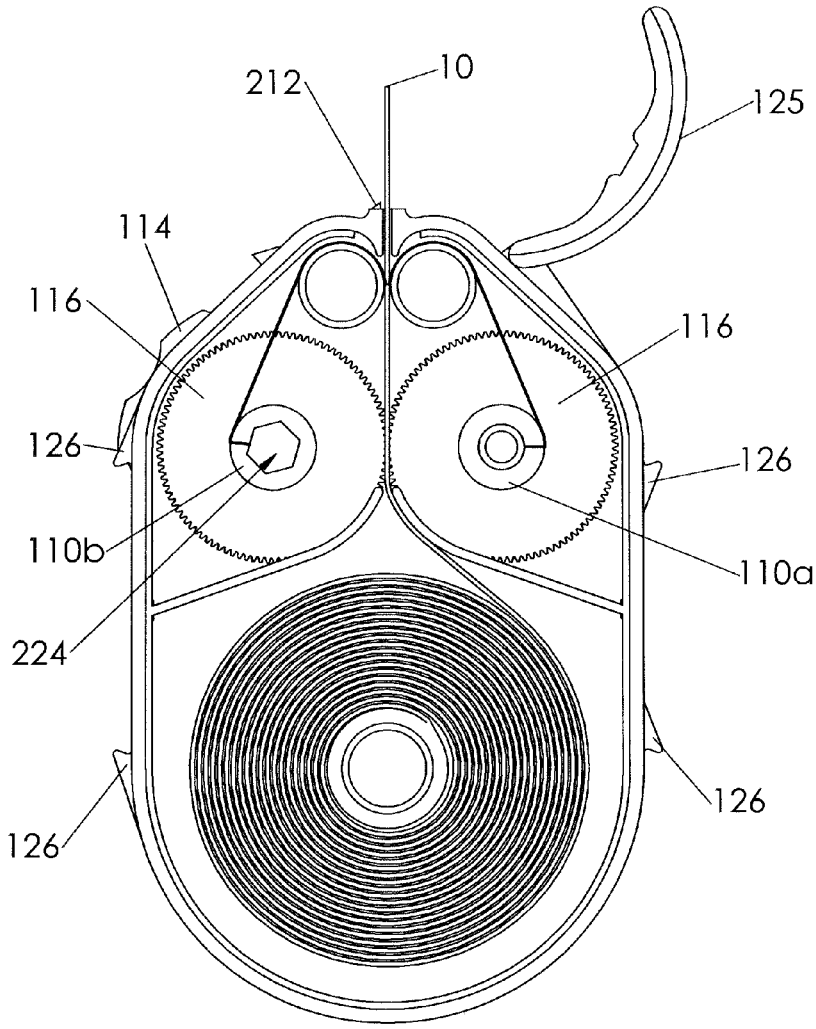
FIG. 12 is a rear view of the dispenser as in FIG. 11*a;*
Figure 13:
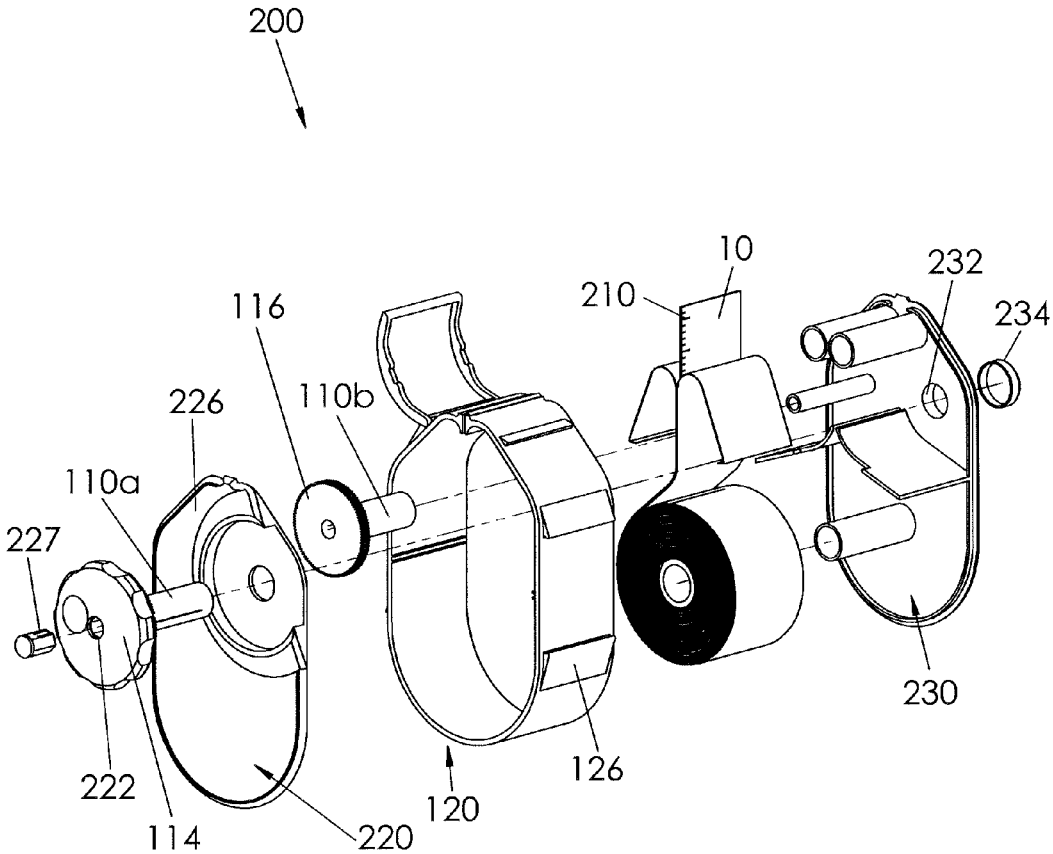
FIG. 13 is an exploded view of the dispenser as in FIG. 9.
Figure 14C:
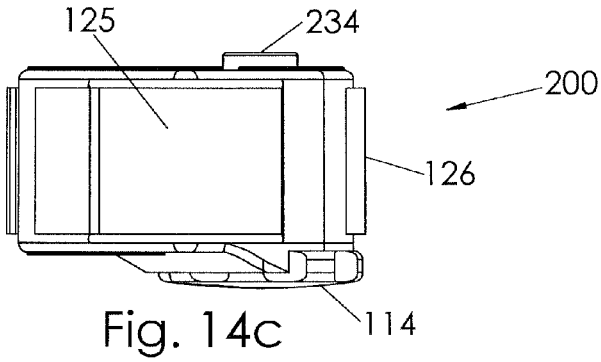
FIG. 14*c* is a top view of the dispenser as in FIG. 8.
Figure 14A:
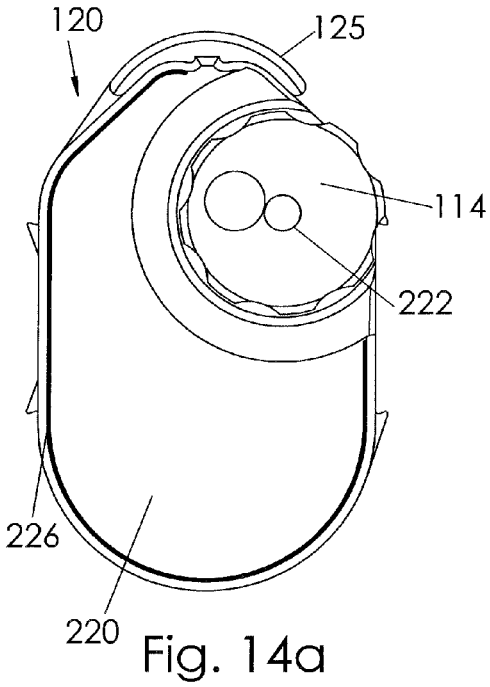
FIG. 14*a* is a front view of the dispenser as in FIG. 8.
Figure 14B:
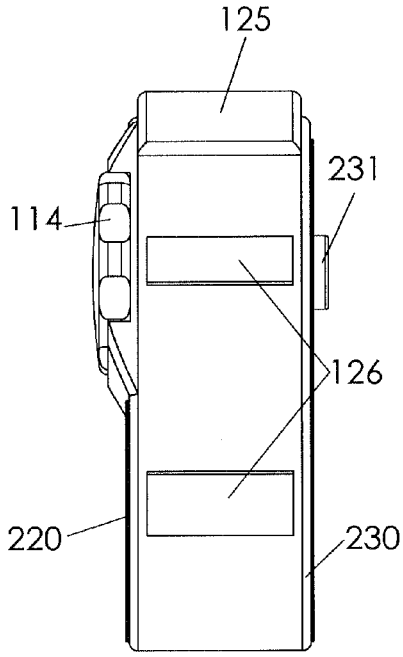
FIG. 14*b* is a side view of the dispenser as in FIG. 8.
Figure 15:
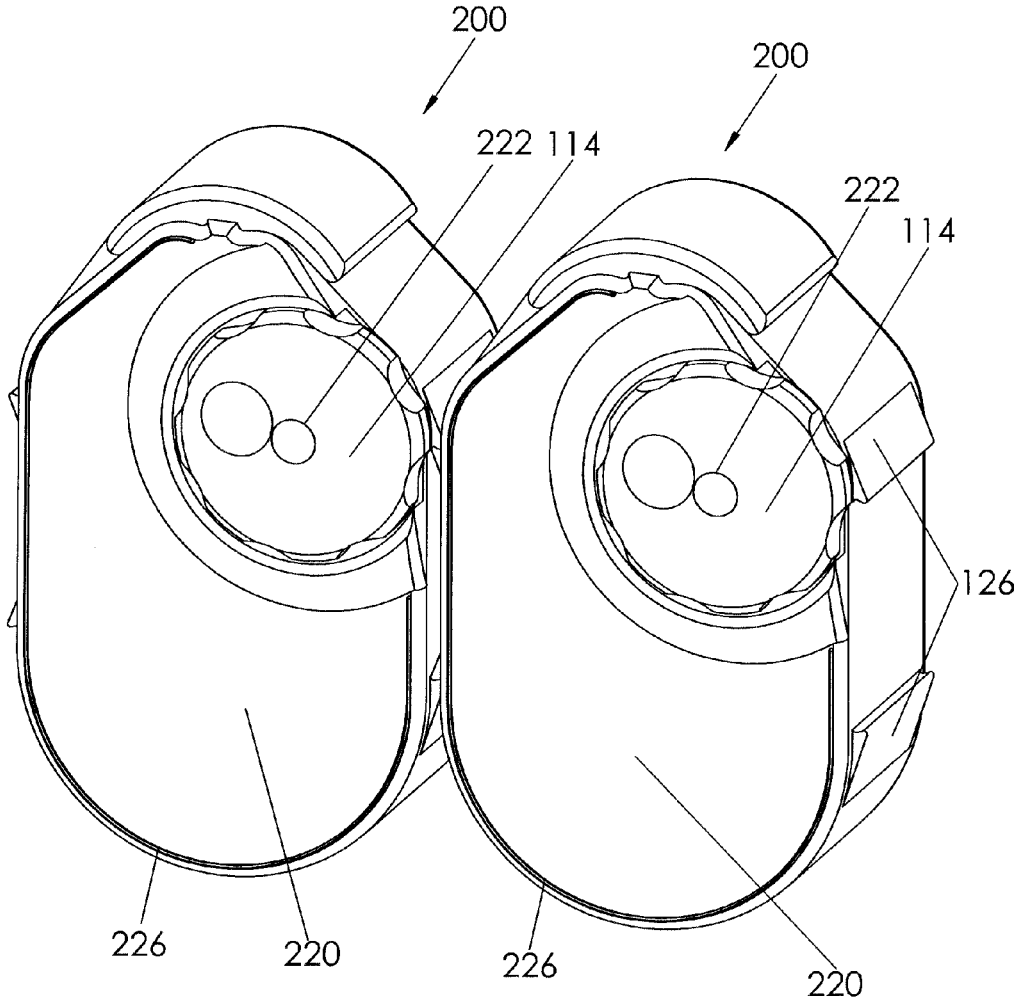
FIG. 15 is a perspective view of two dispensers coupled together in a lateral configuration.
Figure 16:
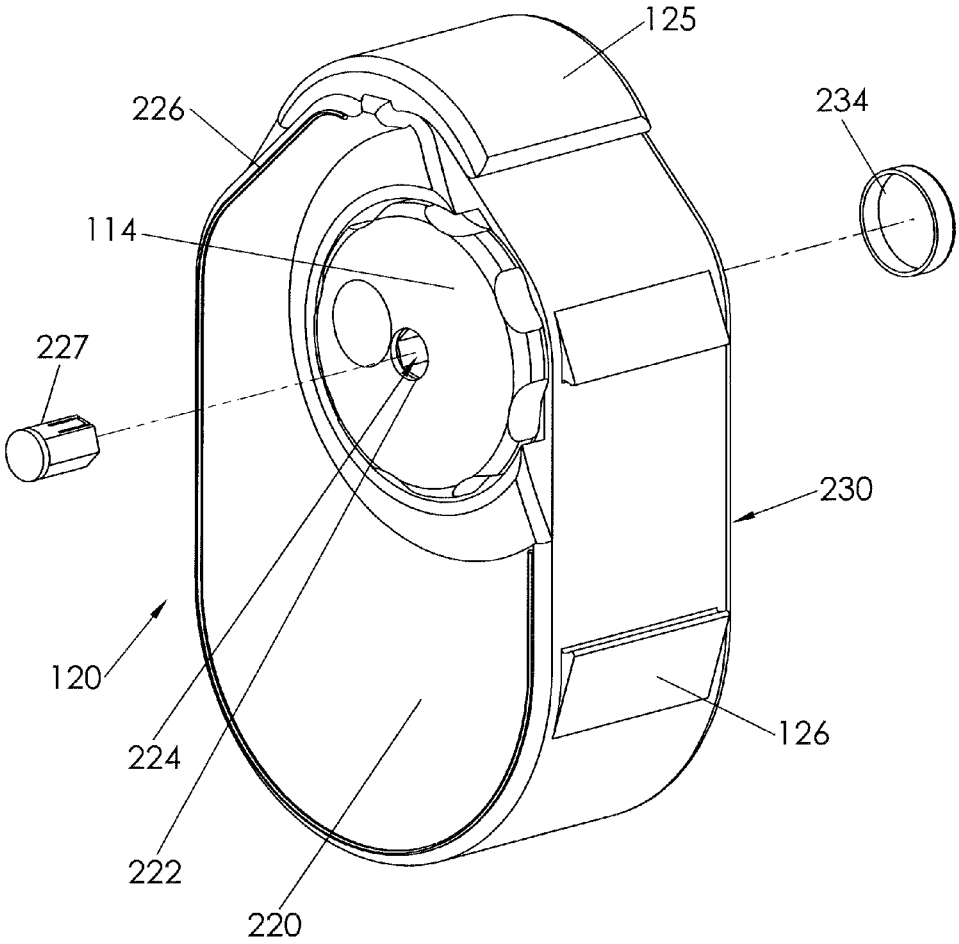
FIG. 16 is a perspective view of the dispenser as in FIG. 8 illustrating selective use of access plugs.
Figure 22B:
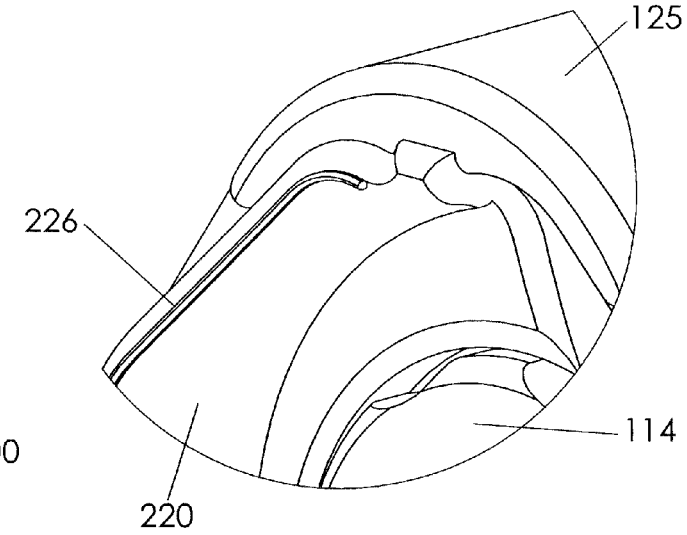
FIG. 22*b* is an isolated view on an enlarged scale taken from a portion of FIG. 22*a;*
Figure 22A:
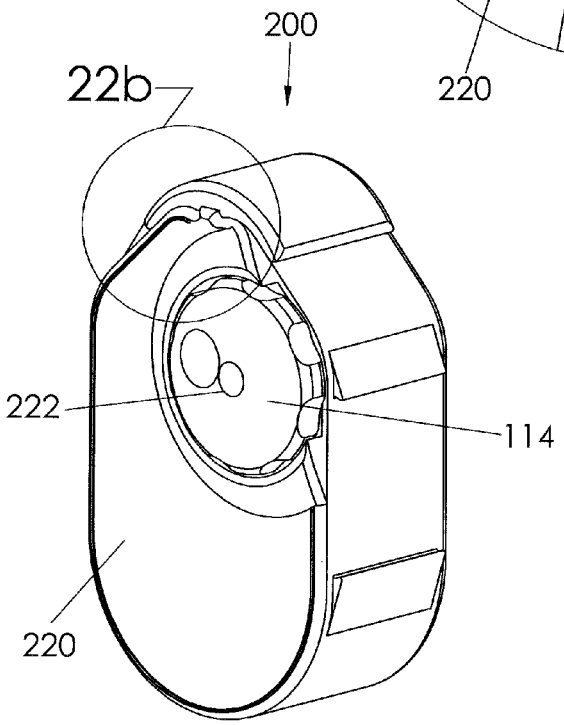
FIG. 22*a* is another front perspective view of the dispenser as in FIG. 8.
Figure 23A:
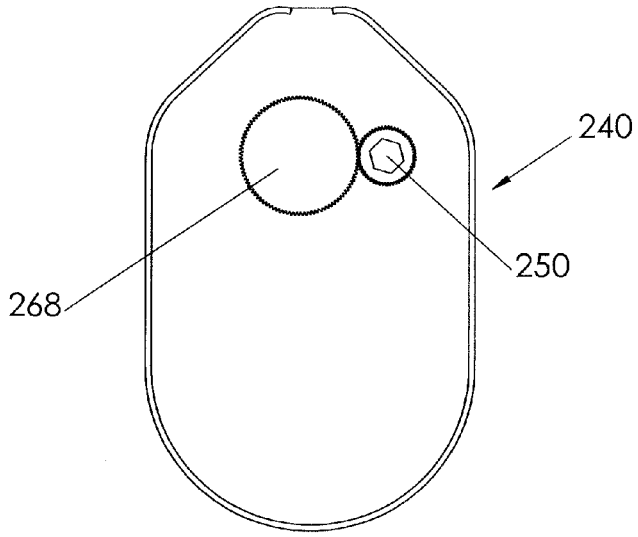
FIG. 23*a* is front view of the spacer plate according to an embodiment having a gear reduction assembly.
Figure 23B:
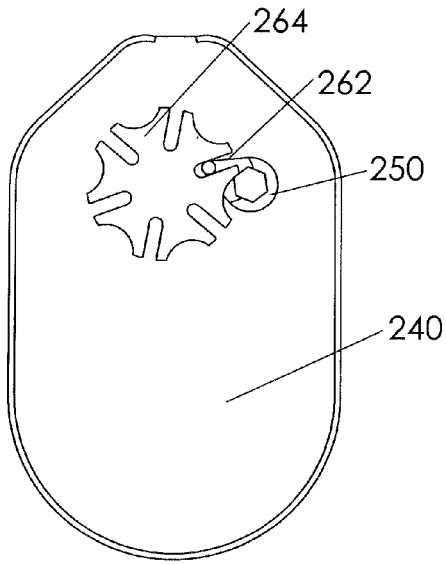
FIG. 23*b* is another front view of the spacer plate as in FIG. 23*b* illustrating another form of a gear reduction assembly.
Figure 23C:
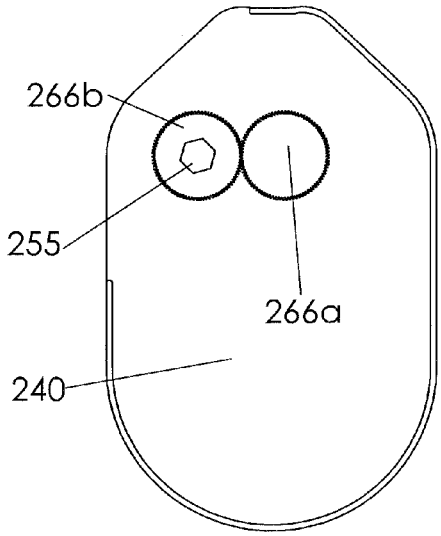
FIG. 23*c* is a rear view of the spacer plate as in FIG. 23*a;*

As shown in FIG. 22*b*, an outer surface of the front plate 220 may include perimeter edges having an alignment/locking ridge 226. Similarly, an outer surface of the rear plate 230 may include perimeter edges having an alignment/locking ridge 236 (FIG. 11*b*). The respective locking ridges will be further explained later.

Figure 17C:
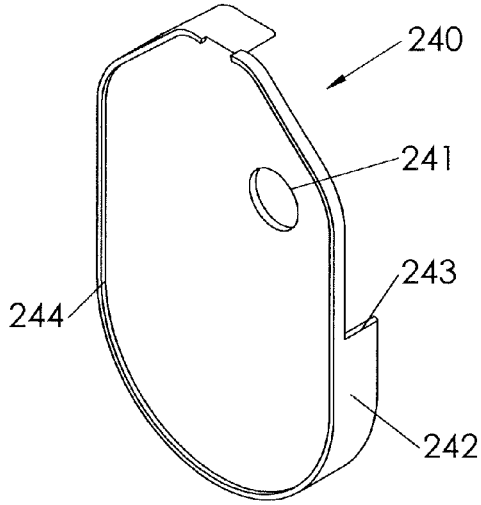
FIG. 17*c* is a perspective view of the spacer plate as in FIG. 17*a;*
Figure 17A:
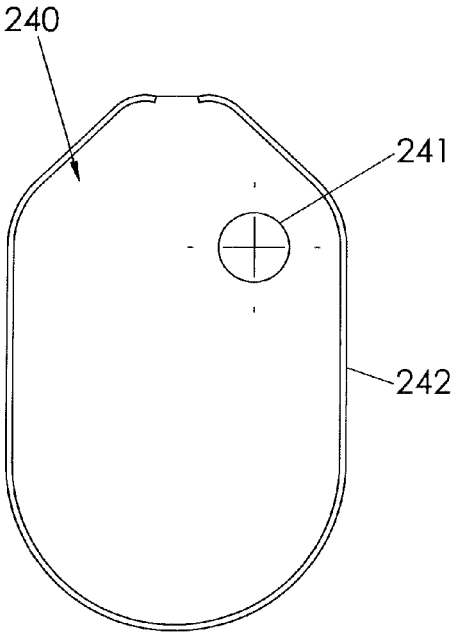
FIG. 17*a* is a front view of a spacer plate.
Figure 17B:
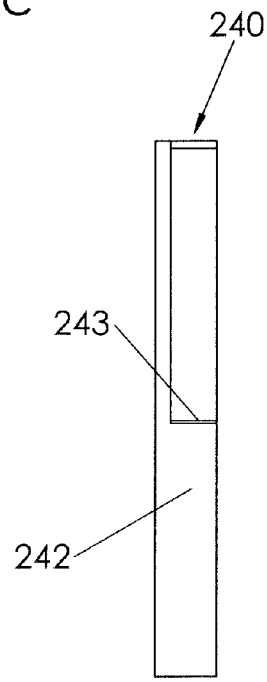
FIG. 17*b* is a side view of the spacer plate as in FIG. 17*a;*
Figure 18:
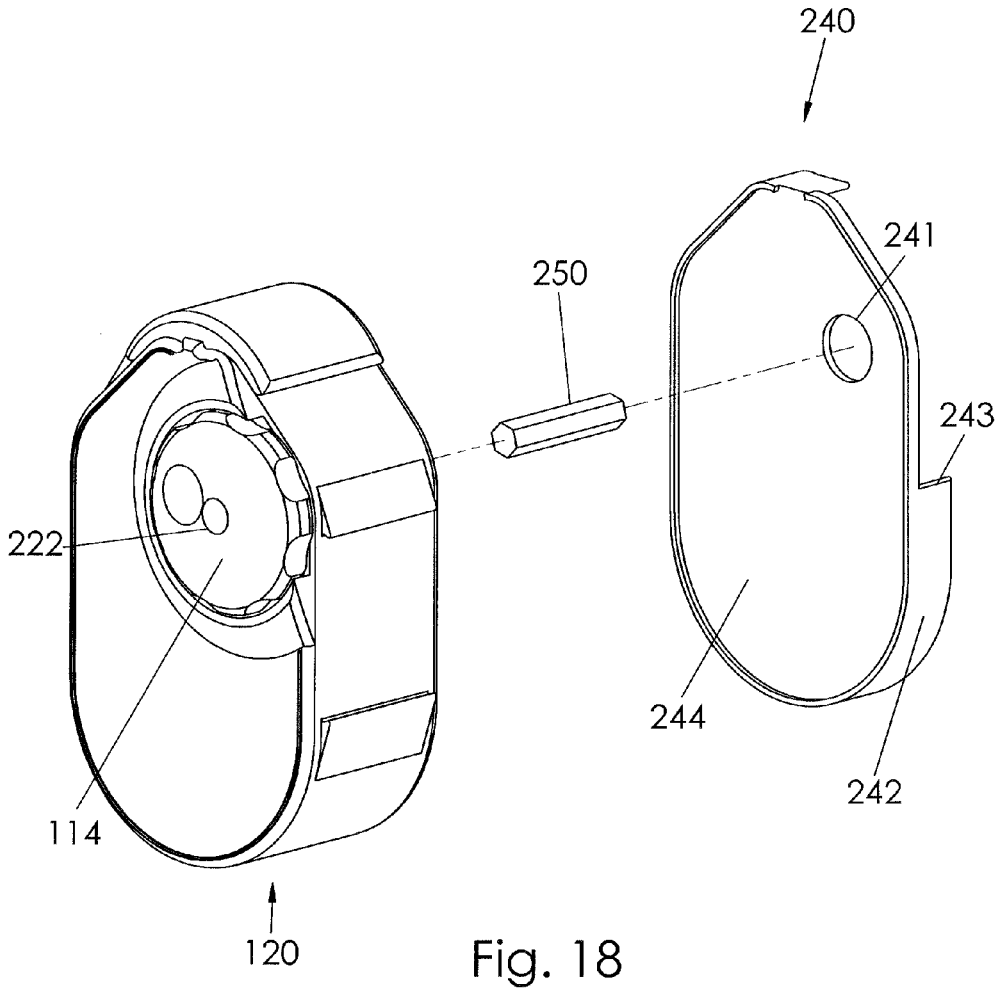
FIG. 18 is an exploded view illustrating the spacer plate and transfer drive shaft.
Figures 19A, 19B:
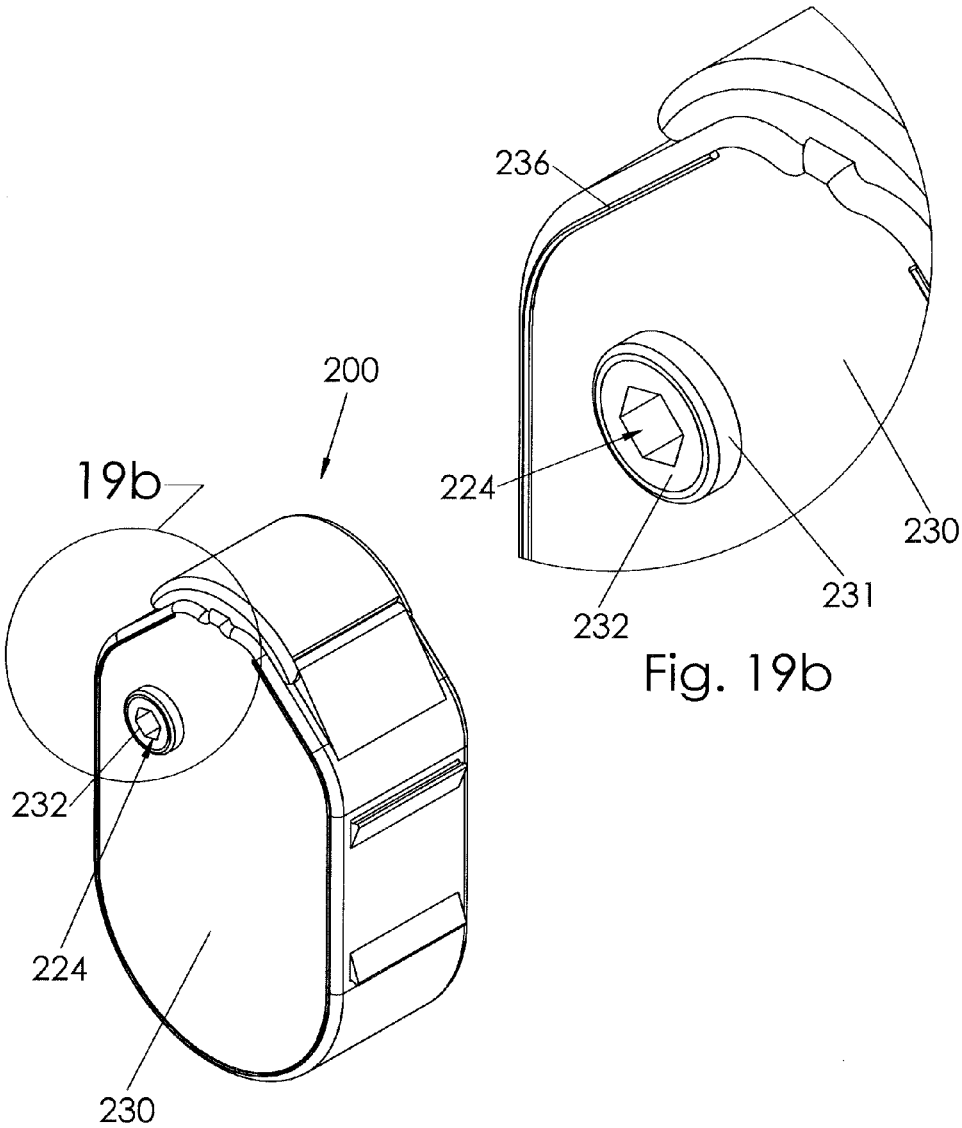
FIG. 19*a* is a rear perspective view of the dispenser as in FIG. 8.
FIG. 19*b* is an isolated view on an enlarged scale taken from a portion of FIG. 19*a;*
Figure 20:
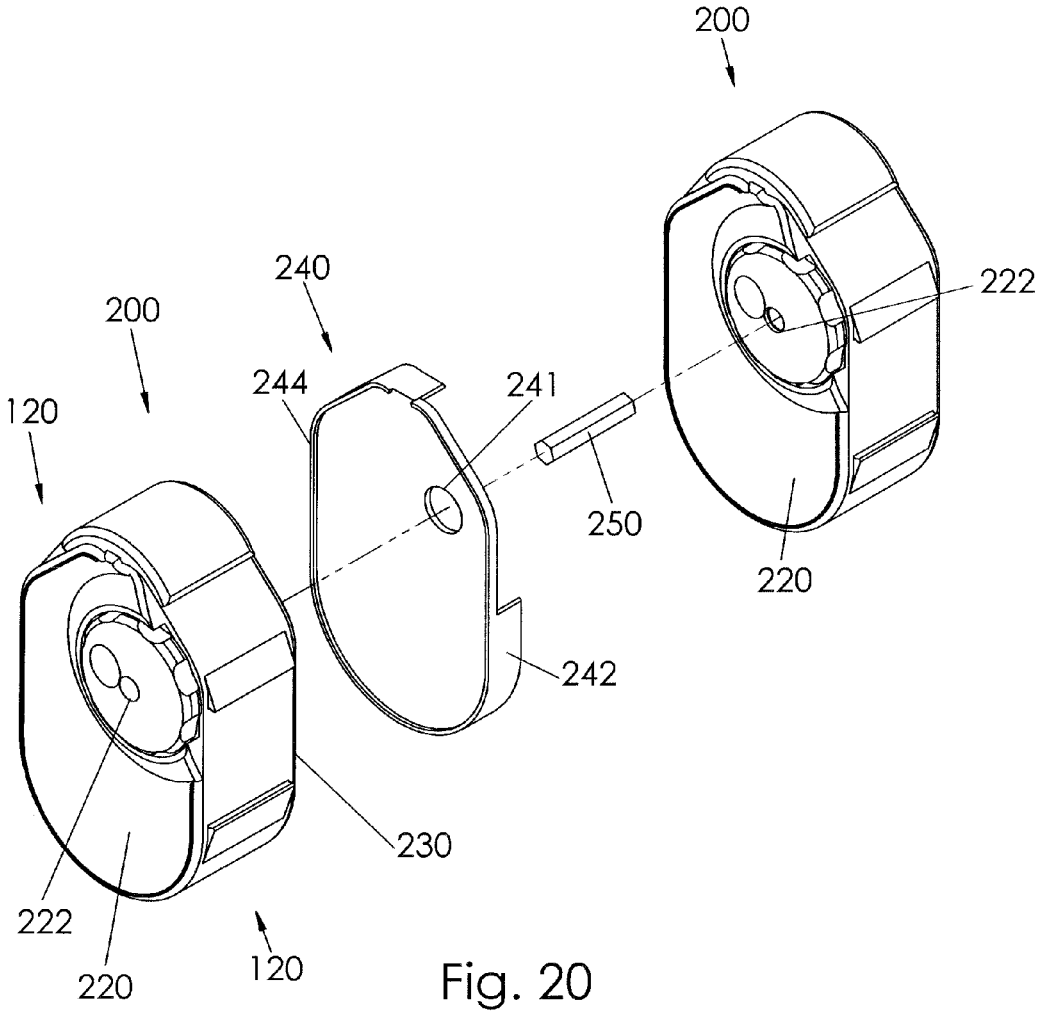
FIG. 20 is an exploded view of a dispenser being coupled to another dispenser in a front-to-back configuration.
Figure 21:
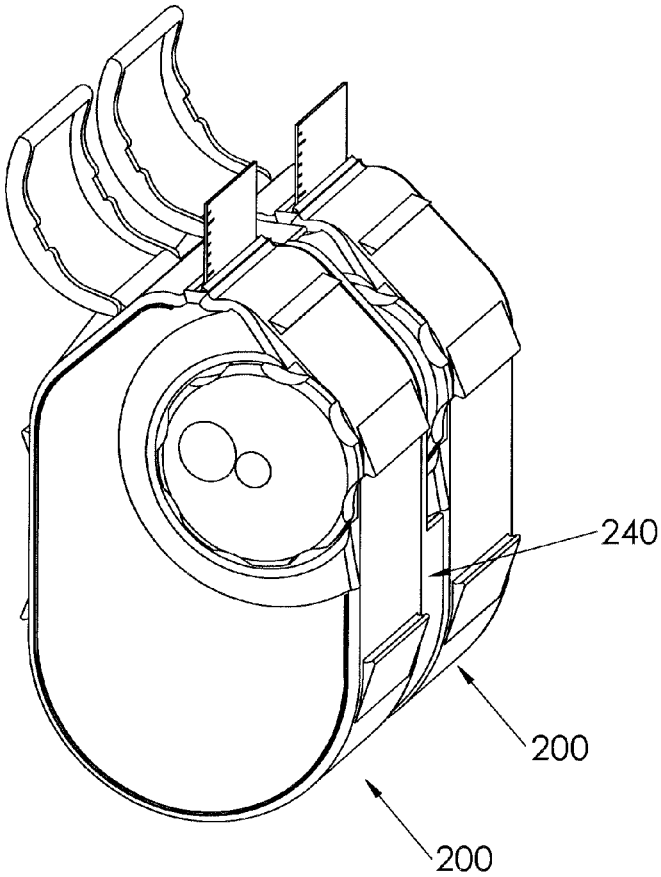
FIG. 21 is a perspective view of the dispenser being coupled to another dispenser as in FIG. 20.

The alternative embodiment of the dispenser 200 may further include a spacer plate 240 having a configuration that enables multiple dispensers to be coupled together in a front-to-back configuration for simultaneous operation. As shown particularly in FIGS. 17*a* to 17*c*, the spacer plate 240 includes front and back surfaces and defines a spacer plate aperture 241 that is registered/aligned with the rear plate output aperture 232 when the spacer plate 240 is attached to the rear plate 230 so that the transfer drive shaft 250 may extend therethrough as described below. More particularly, the back surface of the spacer plate 240 may include a peripheral edge and outward perimeter walls 242 extending away (i.e. also referred to as rearwardly extending walls) from the spacer plate peripheral edge (FIG. 17*c*). The rearwardly extending walls 242 of the spacer plate 240 may include a configuration complementary to the alignment ridge 236 situated on the front plate 220 described previously such that the complementary structures may be releasably coupled together. In some embodiments, the front surface of the spacer plate 240 may also include frontwardly extending walls/ridge 244 having a configuration complementary to the alignment ridge 236 of the rear plate 230 described previously (FIGS. 24 and 25). In other words, the rearwardly extending walls 242 of the spacer plate 240 and ridge 226 of the front plate 220 may selectively engage or releasably engage each other when housings of different dispensers are coupled in a front-to-back arrangement. Similarly, the frontwardly extending walls 244 of the spacer plate 240 may be releasably coupled to the locking ridge 236 of the rear plate 230. Further, the rearwardly extending walls 242 of the spacer plate 240 may define a cutout 243 configured so that there is no interference with the rotatable knob 114 of another dispenser 200 as will be described below (FIGS. 20 and 21). The spacer plate 240 defines a spacer plate aperture 241 that registers/aligns with the rear plate output aperture 232 so that the transfer drive shaft 250 (described below) may extend therethrough.

In some embodiments (not shown), it is contemplated that the rear plate 230 of the housing 120 may also be configured in a manner consistent with that of the spacer plate 240 and, therefore, serve unitarily as both the rear plate 230 of the housing 120 as first described in this specification and as the spacer plate 240.

A transfer drive shaft 250 extends through the channel 224 and associated input 222 and output 232 apertures. The transfer drive shaft 250 is operatively connected to the rotatable knob 114 of a dispenser 200 and is rotated when the knob 114 is rotated. The transfer drive shaft 250 includes a length such that it may extend outwardly from the output aperture 232 of one housing 120, through the spacer plate aperture 241, and into the input aperture 222 of another dispenser housing 120 such that the transfer drive shaft 250 is in operative engagement with the rotatable knob 114 of the another housing 120. Stated another way, the transfer drive shaft 250 of a "first" dispenser may extend away therefrom into operative engagement with a "second" dispenser. Accordingly, an operation of the rotatable knob 114 of the first dispenser causes a simultaneous and equal rotation of the rotatable knob 114 of the second or "another" dispenser.

In the embodiment described immediately above, the transfer drive shaft 250 that connects the rotatable transfer knob of two dispensers causes rotation thereof to rotate at the same speed, i.e. the same amount of rotation. From a practical viewpoint, rotation of the rotatable knob 114 of a first dispenser causes the same amount of a dissolvable strip 10 to be dispensed through the housing slot 122 of the first and second dispensers to which the transfer drive shaft 250 is interconnected as described above. However, the dispenser 200 according to the alternative embodiment disclosed herein may further include a gear modification assembly 260 that is operatively connected or coupled to the distal end 252 of the transfer drive shaft 250 and is also operatively connected or coupled to the input end 254 of the transfer drive shaft of another transfer drive shaft of another dispenser. In other words, the gear modification assembly 260 is situated between the end of a transfer drive shaft 250 extending outwardly from one dispenser and its engagement with the input aperture 222 and channel 224 of another or "second" dispenser.

Figure 24:
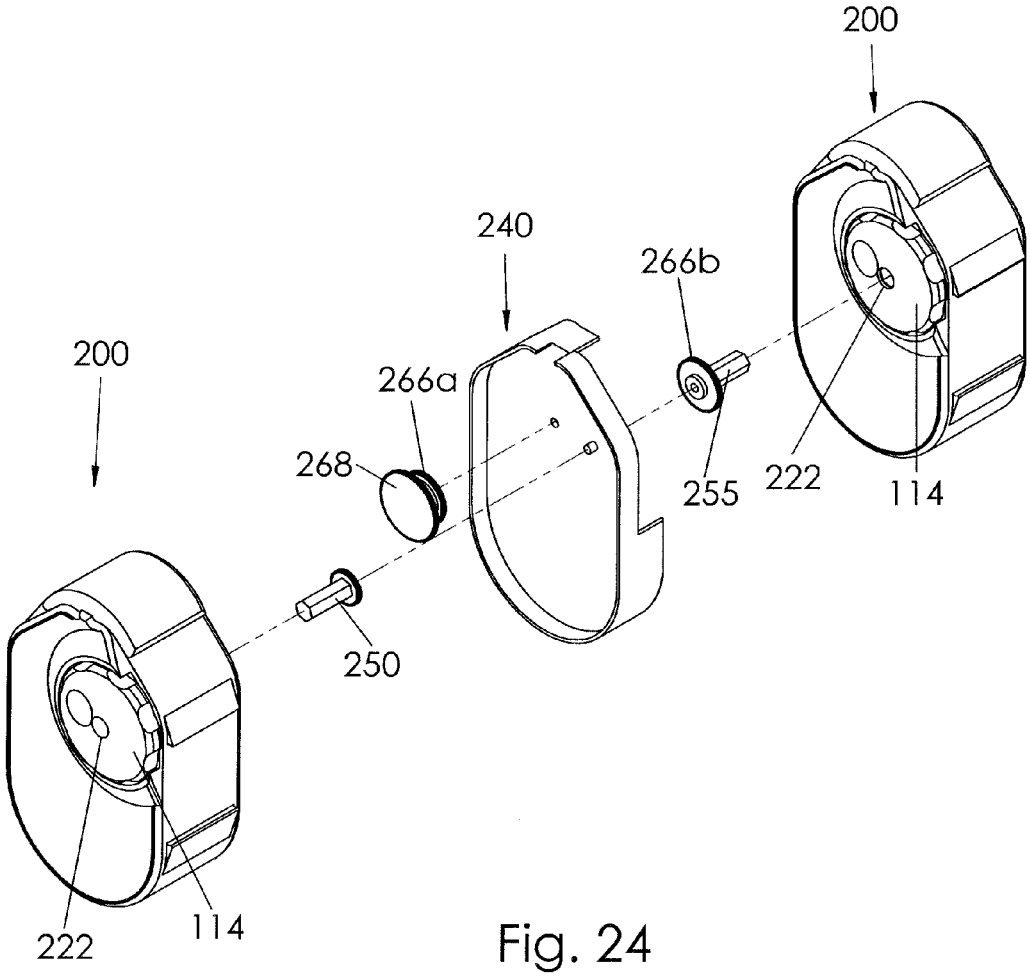
FIG. 24 is an exploded view of the spacer plate and gear reduction assembly as in FIG. 23*a*.
Figure 25:
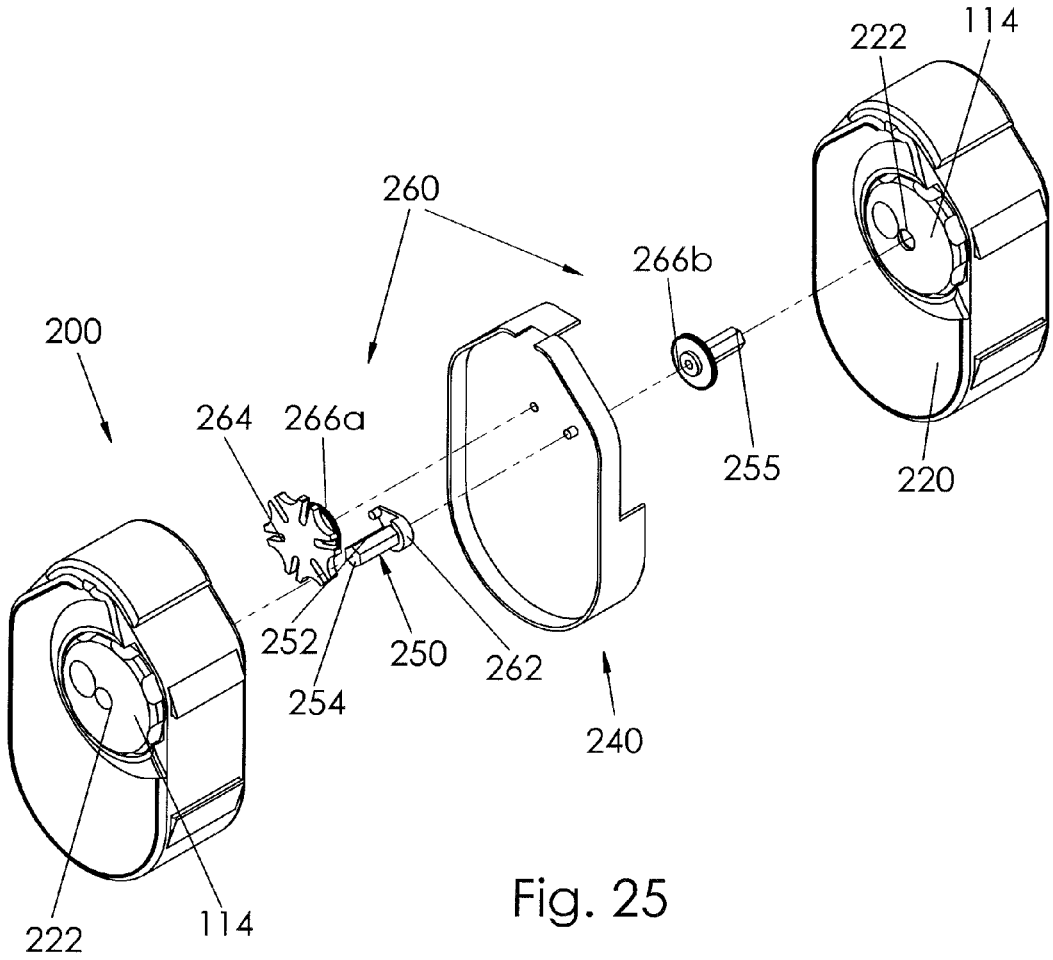
FIG. 25 is an exploded view of the spacer plate and gear reduction assembly as in FIG. 23*b*.

The gear modification assembly 260 includes components and configuration that causes the transfer drive shaft 250 of "another" or "second" dispenser to rotate at a speed different than that of the transfer drive shaft 250 of the initial, first, or original dispenser 200. The gear modification assembly 260 may be configured such that a transfer drive shaft 250 of the so-called "another" or second dispenser to rotate more slowly or more quickly. From a practical viewpoint, the subsequent dispenser may dispense more or less of the dissolvable strip 10 than that dispensed by the first dispenser 200 as a result of the configuration of the gear modification assembly 260. As shown in FIGS. 24 and 25, the spacer plate 240 does not define an aperture through which the drive shaft 250 extends, but rather includes a smaller opening through which components of the gear modification assembly are situated in transferring a modified rotation of the drive shaft 250.

More particularly the gear modification assembly 260 may include an input drive cam 262 coupled to the distal end 252 of the transfer drive shaft 250, the cam 262 then being operatively coupled to an intermittent motion gear 264 (FIG. 25). The intermittent motion gear 264 is operatively coupled to a downstream gear shaft 255 and one or more gear elements 266*a*, 266*b* it being understood that the downstream gear shaft 255 will be operated at a speed different from that of the transfer drive shaft 250 as a result of the intermittent motion gear 264 and cam 262 operation. It should be understood that gear modification assembly 260 essentially interrupts the transfer drive shaft 250 and changes the speed of its rotation. Although an intermittent motion gear 264 is preferred to modify the rotational speed of the transfer drive shaft 250, it is understood that a compound gear unit 268 or specifically configured gear train would also work (FIG. 24). Similarly, the force transfer apparatus may include at least one of a gear train, a pulley system, or a chain and sprocket system (not shown).

Figure 10B:
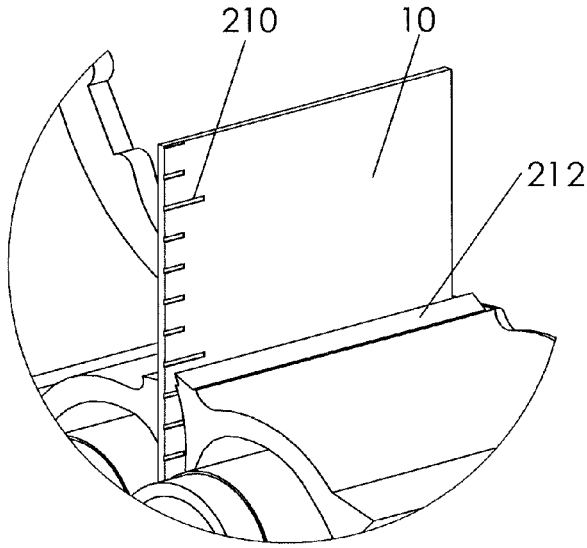
FIG. 10*b* is an isolated view on an enlarged scale taken from a portion of FIG. 10*a;*
Figure 10A:
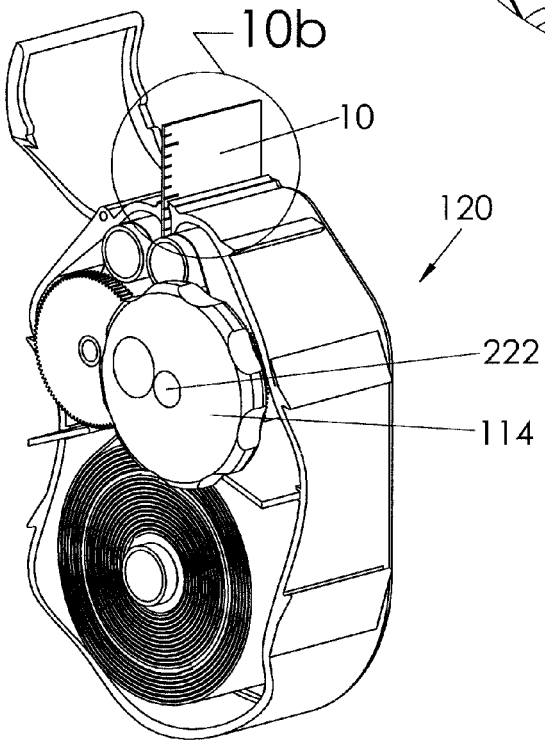
FIG. 10*a* is a perspective view of the dispenser as in FIG. 9 with a front plate removed

The dispenser 200 according to the alternative embodiment of the present invention may also include a cutting member 212 to aid a user in tearing or severing a desired amount of the dissolvable strip 10. More particularly, the cutting member 212 may be positioned on an exterior of the housing 120 immediately adjacent the housing slot 122 (FIG. 10*b*). Preferably, the cutting member 212 extends along the slot 122 such that the dissolvable strip 10 may be selectively severed by a user upon urging the strip 10 to the side of the slot 122 and against the cutting member 212. Further, the dissolvable strip 10 may include indicia 210 indicative of a length measuring scale (FIG. 10*b*), i.e. like that found on a ruler. The indicia 210 is desirable in that it enables a user to dispense a desired amount of a continuous medicine strip 10 and then sever it.

In use, the normal function of the dispenser 200 is as first described above so as to dispense orally dissolvable strips, such as for dispensing pharmaceutical substances. The embodiment immediately described above, provides a unique structure for not only coupling two or more dispensers together in a lateral or side-by-side configuration, but to coupling two or more dispensers together in a front-to-back configuration and with a structure that allows multiple dispensers to be actuated together with a single operation of the rotatable knob 114 of the front-most dispenser. The transfer drive shaft 250 coupled to the rotatable knob 114 extends through the output aperture 232 of the dispenser housing 120 and through the spacer plate aperture 241 and into engagement with the input aperture 222 and rotatable knob 114 of another or second dispenser. It is understood that this configuration may be repeated with multiple dispensers being coupled together. A rotation of the rotatable knob 114 actuates the spools contained in the housing 120 to dispense a medicine strip 10 as described above. The rotation of the rotatable knob 114 also causes the transfer drive shaft 250 to rotate/actuate a coupled next dispenser(s). Accordingly, dissolvable strips from all of the coupled dispensers are dispensed simultaneously without individual operation of each separate dispenser. In embodiments including a gear modification assembly 260, the dispensers coupled to the first/front dispenser may dispense more or less dissolvable strips, depending on the configuration.

Accordingly, it can be seen that embodiment of the invention described immediately above provides a convenience never before known or disclosed regarding dispensers of orally dissolvable medicine strips or any other type of dispensers. In this way, a patient is able to manage the dispensing of multiple types and quantities of medicine with a single rotation of a front-most dispenser.

It is understood that while certain forms of this invention have been illustrated and described, it is not limited thereto except insofar as such limitations are included in the following claims and allowable functional equivalents thereof.

The invention claimed is:

1. A dispenser for an orally dissolvable strip sandwiched between two layers of wrap material, the dispenser comprising:

first and second generally parallel receiving spools for receiving the respective layers of wrap material, said receiving spools being spaced apart for the orally dissolvable strip and the layers of wrap material to pass between, said first spool being operatively coupled to said first layer of wrap material, said second spool being operatively coupled to said second layer of wrap material;

a force transfer apparatus operatively coupled to said first and second spools and configured to rotate said second spool when said first spool rotates;

a housing having opposed front and rear plates and opposed side walls connecting said front and rear plates, said housing defining an interior area configured to contain said first and second receiving spools, said force transfer apparatus, said orally dissolvable strip, and said layers of wrap material, said housing defining a slot sized for the orally dissolvable strip to pass through;

a rotatable knob operatively coupled to said first spool for causing said first spool to rotate, said rotatable knob being accessible outside said housing;

a coupling element connected to a respective housing side wall configured to selectively and releasably couple said housing laterally to another housing;

wherein:

said rotatable knob defines an input aperture;

said rear plate defines an output aperture;

said housing includes a channel extending between said input and output apertures;

a transfer drive shaft positioned in said channel, said transfer drive shaft having a proximal end operatively coupled to said rotatable knob and a distal end extending away from said output aperture outside said housing;

wherein said distal end of said transfer drive shaft includes a configuration that is complementary with a configuration of said input aperture so as to be selectively receivable in another rotatable knob input aperture.

2. The dispenser of claim 1, further comprising:

a spacer plate having front and back surfaces and defining a spacer plate aperture that is aligned with said rear plate output aperture when said space plate is coupled to said rear plate;

wherein:

said spacer plate back surface includes a peripheral edge and walls extending rearwardly from said peripheral edge;

said housing front plate includes a peripheral edge having a configuration that is complementary to a configuration of said rearwardly extending walls of said housing spacer plate such that said rearwardly extending walls of said spacer plate selectively mate with said front plate peripheral edge of said another housing;

said spacer plate front surface includes a peripheral edge and walls extending frontwardly from said peripheral edge;

said housing rear plate includes a peripheral edge having a configuration that is complementary to a configuration of said frontwardly extending walls of said housing spacer plate such that said frontwardly extending walls of said spacer plate selectively mate with said rear plate peripheral edge of said housing; and said rearwardly extending walls of said spacer plate define a cutout configured so that said rear plate does not interfere with said rotatable knob when said rear plate is coupled to said front plate peripheral edge of sad another housing.

3. The dispenser of claim 1, wherein said transfer drive shaft includes a hexagonal configuration.

4. The dispenser of claim 1, further comprising:

a cutting member positioned adjacent said housing slot;

wherein said dissolvable strip includes an indicia indicative of a measurement such that said dissolvable strip is selectively severable at a selected position relative to said indicia.

5. The dispenser of claim 1, further comprising:

an input access plug having a configuration complementary to a configuration of said input aperture and said channel such that said input access plug is selectively received in said input aperture;

an output access plug having a configuration complementary to a configuration of said output aperture and said channel such that said output access plug is selectively received in said output aperture.

6. The dispenser of claim 1, further comprising a gear modification assembly operatively coupled to said distal end of said transfer drive shaft and selectively operatively connected to another transfer drive shaft of another dispenser, said gear modification assembly being configured to rotate said another transfer drive shaft at a speed different than a speed of said transfer drive shaft.

7. The dispenser of claim 6, wherein said gear modification assembly includes a gear train having a plurality of gears configured to either reduce or increase the speed of rotation of said transfer drive shaft, said gear train being operatively connected to said transfer drive shaft and to said another transfer drive shaft.

8. The dispenser of claim 1, wherein said force transfer apparatus includes at least one of a gear train, a pulley system, or a chain and sprocket system.

9. The dispenser of claim 1, further comprising a protective cap movably coupled to said housing to selectively expose and conceal said housing slot.

10. The dispenser of claim 4, wherein said housing is airtight when said cap conceals said housing slot.

11. The dispenser of claim 1, wherein:

said first and second spools rotate only in opposed directions; and said force transfer apparatus is configured to rotate said second spool at generally the same speed as said first spool.

12. The dispenser of claim 1, further comprising first and second guide rollers in said housing adjacent said housing slot to direct the orally dissolvable strip outwardly through said housing slot, and wherein:

a respective layer of wrap material passes over said first guide roller before reaching said first receiving spool;

the other layer of wrap material passes over said second guide roller before reaching said second spool; and said first and second guide rollers are positioned to cause generally adjacent points of the two layers of wrap material to separate from the orally dissolvable strip at generally the same time.

13. The dispenser of claim 1, further comprising:

a first wedge positioned between said first guide roller and the orally dissolvable strip for separating one of the layers of wrap material from the orally dissolvable strip; and a second wedge positioned between said second guide roller and the orally dissolvable strip for separating the other layer of wrap material from the orally dissolvable strip;

wherein said housing includes a coupling element for selectively coupling said housing to a housing of another dispenser.

14. The dispenser of claim 11, further comprising:

a first wedge positioned between said first guide roller and the orally dissolvable strip for separating one of the layers of wrap material from the orally dissolvable strip; and a second wedge positioned between said second guide roller and the orally dissolvable strip for separating the other layer of wrap material from the orally dissolvable strip.

15. The dispenser of claim 1, wherein said orally dissolvable strip includes at least one of a medication, a breath freshener, or a nutritional supplement.

16. The dispenser of claim 15, wherein one of said plurality of gears includes an intermittent motion gear.

17. The dispenser of claim 1, wherein:

said rear plate includes a peripheral edge and walls extending rearwardly from said peripheral edge;

said housing front plate includes a peripheral edge having a configuration that is complementary to a configuration of said rearwardly extending walls of said housing rear plate such that said rearwardly extending walls of said housing selectively mate with said front plate peripheral edge of said another housing; and said rearwardly extending walls define a cutout configured so that said rear plate does not interfere with said rotatable knob when said rear plate is coupled to said front plate peripheral edge of said another housing.

* * * * *